US007501769B2

(12) United States Patent
Farmer

(10) Patent No.: US 7,501,769 B2
(45) Date of Patent: Mar. 10, 2009

(54) LIGHT FIXTURE WITH A DIAGNOSTIC BALLAST

(75) Inventor: Edmund Farmer, Cranford, NJ (US)

(73) Assignee: Verilux, Inc., Stamford, CT (US)

( * ) Notice: Subject to any disclaimer, the term of this patent is extended or adjusted under 35 U.S.C. 154(b) by 306 days.

(21) Appl. No.: 11/256,464

(22) Filed: Oct. 21, 2005

(65) Prior Publication Data

US 2006/0087854 A1 Apr. 27, 2006

Related U.S. Application Data

(62) Division of application No. 10/366,116, filed on Feb. 13, 2003, now abandoned.

(51) Int. Cl.
*H01J 1/60* (2006.01)

(52) U.S. Cl. ..... 315/129; 315/131; 315/136; 315/56; 315/29

(58) Field of Classification Search ..... 315/129, 315/131–136, 56–59, 291, 307, 362
See application file for complete search history.

(56) References Cited

U.S. PATENT DOCUMENTS

| | | | | | |
|---|---|---|---|---|---|
| 1,790,500 | A | | 1/1931 | Fischer | |
| 3,706,983 | A | * | 12/1972 | Olson et al. | 315/130 |
| 3,956,733 | A | * | 5/1976 | Sakurai | 340/458 |
| 4,318,031 | A | * | 3/1982 | Lonseth et al. | 315/133 |
| 4,451,693 | A | | 5/1984 | Vest | |
| 4,463,413 | A | | 7/1984 | Shirley | |
| 4,494,177 | A | | 1/1985 | Matthews | |
| D278,463 | S | | 4/1985 | Vest | |
| 4,785,385 | A | | 11/1988 | Holst | |
| D301,633 | S | | 6/1989 | Shwisha | |
| 4,885,670 | A | | 12/1989 | Baake | |
| 4,936,789 | A | | 6/1990 | Ugalde | |
| 4,956,756 | A | | 9/1990 | Hsiao | |
| 5,034,865 | A | | 7/1991 | Sonneman | |
| 5,062,028 | A | | 10/1991 | Frost et al. | |
| 5,065,292 | A | | 11/1991 | Aubrey | |
| 5,084,810 | A | | 1/1992 | Huang | |
| 5,135,407 | A | | 8/1992 | Berends | |
| 5,189,339 | A | | 2/1993 | Peshak | |
| 5,205,645 | A | | 4/1993 | Lee | |
| 5,222,806 | A | | 6/1993 | Roberts, III | |
| 5,381,322 | A | | 1/1995 | Humphreys | |
| 5,442,257 | A | * | 8/1995 | Mitsumoto | 315/129 |
| 5,585,688 | A | | 12/1996 | DeKleine | |
| 5,615,946 | A | | 4/1997 | Yeh | |
| 5,620,247 | A | | 4/1997 | Swanson | |
| 5,716,126 | A | | 2/1998 | Meyer | |
| 5,929,781 | A | * | 7/1999 | Vosika | 340/825.72 |
| 6,124,673 | A | | 9/2000 | Bishop | |
| 6,127,782 | A | * | 10/2000 | Flory et al. | 315/129 |
| 6,133,695 | A | * | 10/2000 | Caya et al. | 315/119 |

(Continued)

*Primary Examiner*—Tuyet Vo
(74) *Attorney, Agent, or Firm*—St. Onge Steward Johnston & Reens LLC

(57) ABSTRACT

The invention relates to a light fixture assembly having a ballast substantially maintaining a consistent current and further includes an indicator for indicating a problem with the light fixture assembly. A switch remote from the ballast may be provided where a circuit in cooperation with the switch impedes the flow of electricity through the ballast when the switch is in an off position. The light fixture assembly may be assembled and disassembled, namely the lamp head, post, base, ballast, and electrical cord, without use of a tool.

12 Claims, 11 Drawing Sheets

U.S. PATENT DOCUMENTS 6,206,545 B1 3/2001 Yan
6,280,053 B1 * 8/2001 Chien ..... 362/228
D449,398 S 10/2001 Tsao
D451,617 S 12/2001 David et al.
6,429,593 B1 8/2002 Stegmaier et al.
6,462,478 B1 10/2002 Oetken et al.
6,582,253 B1 6/2003 Lau
7,107,744 B2 * 9/2006 Suhara ..... 56/11.4
2004/0202011 A1 * 10/2004 Lee ..... 362/802

* cited by examiner

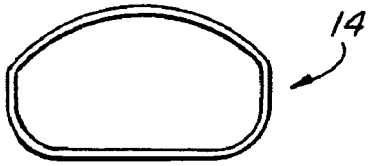
FIG. 3c
FIG. 3a
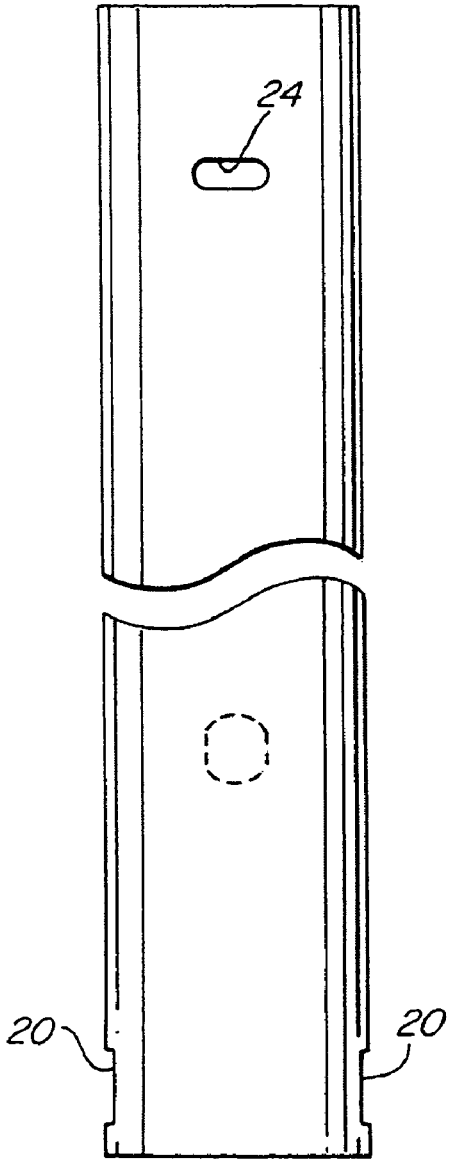
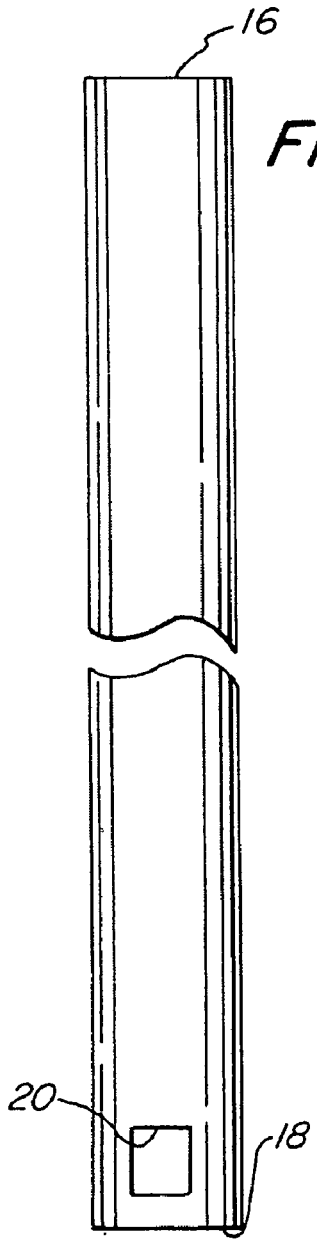
FIG. 3b

LIGHT FIXTURE WITH A DIAGNOSTIC BALLAST

PRIORITY DOCUMENTS

This patent application is a divisional of U.S. patent application Ser. No. 10/366,116, filed Feb. 13, 2003 now abandoned.

FIELD OF THE INVENTION

The invention relates to an improved lamp assembly.

BACKGROUND OF THE INVENTION

Lamp assemblies generally include a variety of components for providing light, such as a bulb, socket for holding the bulb, a base for supporting the bulb and socket, and an electrical cord that brings electricity from a wall plug through the base to the socket to illuminate the bulb. Another component often used with a lamp assembly is a ballast for helping to maintain a consistent current by varying its resistance when counteracting changes in voltage.

Typically, when the lamp assembly fails to produce light, the bulb is a usual point of failure. This may be due to the heat generated and sudden surges of electricity at the bulb. Although the bulb is usually first to fail, other components of the lamp assembly may also fail, such as the electrical cord where frequent traffic over the cord may cause the insulation or wiring to break down and/or separate. Such a failure at the electrical cord may also be a fire hazard. Electrical wiring within the base that brings electricity from the electrical cord to the socket may also fail, typically due to age, and need to be replaced. With several points of failure, it may be difficult to determine the exact type of failure and/or location of the failure when the usual symptom of a problem with the lamp assembly is often the same; the bulb fails to provide light. U.S. Pat. Nos. 4,885,670 to Baake and 6,124,673 to Bishop appear to relate to safety lights having ballasts remote from the light bulbs and sockets but do not seem to indicate a type or location of failure, should a failure occur, within the lamp assemblies.

Additionally, once the lamp assembly ceases to function properly, some lamp assemblies may cut off a flow of electricity, usually by employing a fail safe switch, as a safety precaution. However, if the fail safe switch is located at the bulb or base of a lamp assembly, this means the electrical cord may still have electricity flowing through it, thereby possibly posing a safety concern. U.S. Pat. No. 6,462,478 to Oetken appears to relate to a safety switch for a lamp, which cuts electricity at the safety switch and does not seem to cut the flow of electricity prior to the switch. To enhance safety, it may be beneficial to cut the flow of electricity prior to reaching the switch, base, and/or the electrical cord.

Once a location and/or type of failure is determined, corrective action may be taken to repair the failure. However, although the bulb is normally easy to replace, other components may prove to be cumbersome. Therefore, if the wiring within the base or the electrical cord fails, the entire lamp assembly may be discarded even if other components are operating properly. This practice may become more prevalent if the lamp assembly is relatively inexpensive or the user does not wish to undertake the challenge to replace cumbersome components.

Once a failed component has been identified, a replacement component is generally desired so that the failed component may be replaced. Typically, there are many different kinds of lamp assemblies available in all sorts of shapes and sizes. Therefore, it may be possible for components of one lamp assembly to be incompatible with another lamp assembly. Hence, should a component fail, the user may be required to buy a replacement component from a manufacturer of the particular lamp assembly, which may be more expensive due to a possible monopoly on replacement components or which may prove difficult if the manufacturer that made the lamp assembly is no longer in business or no longer makes the desired replacement component. Therefore, components that are interchangeable with a variety of different lamp assemblies may prove beneficial due to its compatibility among varied assemblies. U.S. Pat. No. 5,034,865 to Sonneman appears to relate to a lamp assembly having components that may be constructed at different locations and assembled by a common manufacturer but the invention does not seem to relate to replaceable components that are compatible among varying lamp assemblies by varying manufacturers.

What is desired, therefore, is a lamp assembly that indicates, should a failure occur, a type or location of the failure. What is also desired is a lamp assembly that provides a fail safe switch that cuts a flow of electricity prior to entering the lamp assembly or prior to reaching the switch. A further desire is a lamp assembly that has replaceable components that are easy to remove and install. Another desire is a lamp assembly that has components which are compatible with other lamp assemblies.

SUMMARY OF THE INVENTION

Accordingly, it is an object of the invention to provide a lamp assembly that helps identify any functional problems.

Another object of the invention is to provide a lamp assembly with improved safety.

It is another object of the invention to provide a lamp assembly where the components are easily assembled and disassembled without tools.

A further object is to provide a lamp assembly having components that are easily assembled and disassembled with components of other lamp assemblies.

These and other objects of the invention are achieved by provision of a lamp assembly having a lamp head for housing a bulb and socket, where the lamp head further includes a handle integrally formed with the lamp head. The lamp assembly also includes a post having a top end and a bottom end, where the top end is coupled to the lamp head and the bottom end has a recess that engages with a protrusion in the base for securing the post to the base.

Optionally, a ballast is provided for helping to maintain a consistent current. An electrical cord connects the base to the ballast and the lamp head, post, base, ballast, and electrical cord are individually removable.

Preferably, the lamp assembly is assembled and disassembled, namely the lamp head, post, base, ballast, and electrical cord, without use of a tool.

Additionally, the handle is generally perpendicular to the post and the bulb is generally perpendicular to the post.

In another embodiment, the ballast includes a light for indicating a problem with the lamp assembly, a switch remote from the ballast, and a circuit in cooperation with the switch that stops electricity from passing through the ballast when the switch is in an off position.

The light may indicate a location and/or type of failure on the lamp assembly.

In another embodiment, the lamp head includes a bulb having a base, the base having a first surface, a second surface, a peripheral surface extending around a periphery of the base and extending from the first surface to the second surface. The base further includes at least one extension outside the peripheral surface and extending from the first surface toward the second surface.

Additionally, a socket is provided to receive the base. The socket includes a distal end, a proximal end, and a cavity extending from the distal end to the proximal end for receiving the base. Moreover, the socket has at least one notch in a wall of the cavity for receiving the at least one extension.

Both the base and at least one extension are removable placed in the cavity and at least one notch, respectively.

The invention and its particular features and advantages will become more apparent from the following detailed description considered with reference to the accompanying drawings.

BRIEF DESCRIPTION OF THE DRAWINGS

FIG. 3*a* depicts a front view of the post of the lamp assembly.

FIG. 3*b* depicts a side view of the post of the lamp assembly.

FIG. 3*c* depicts a top view of the post of the lamp assembly.

DETAILED DESCRIPTION OF THE DRAWINGS

Figure 1:
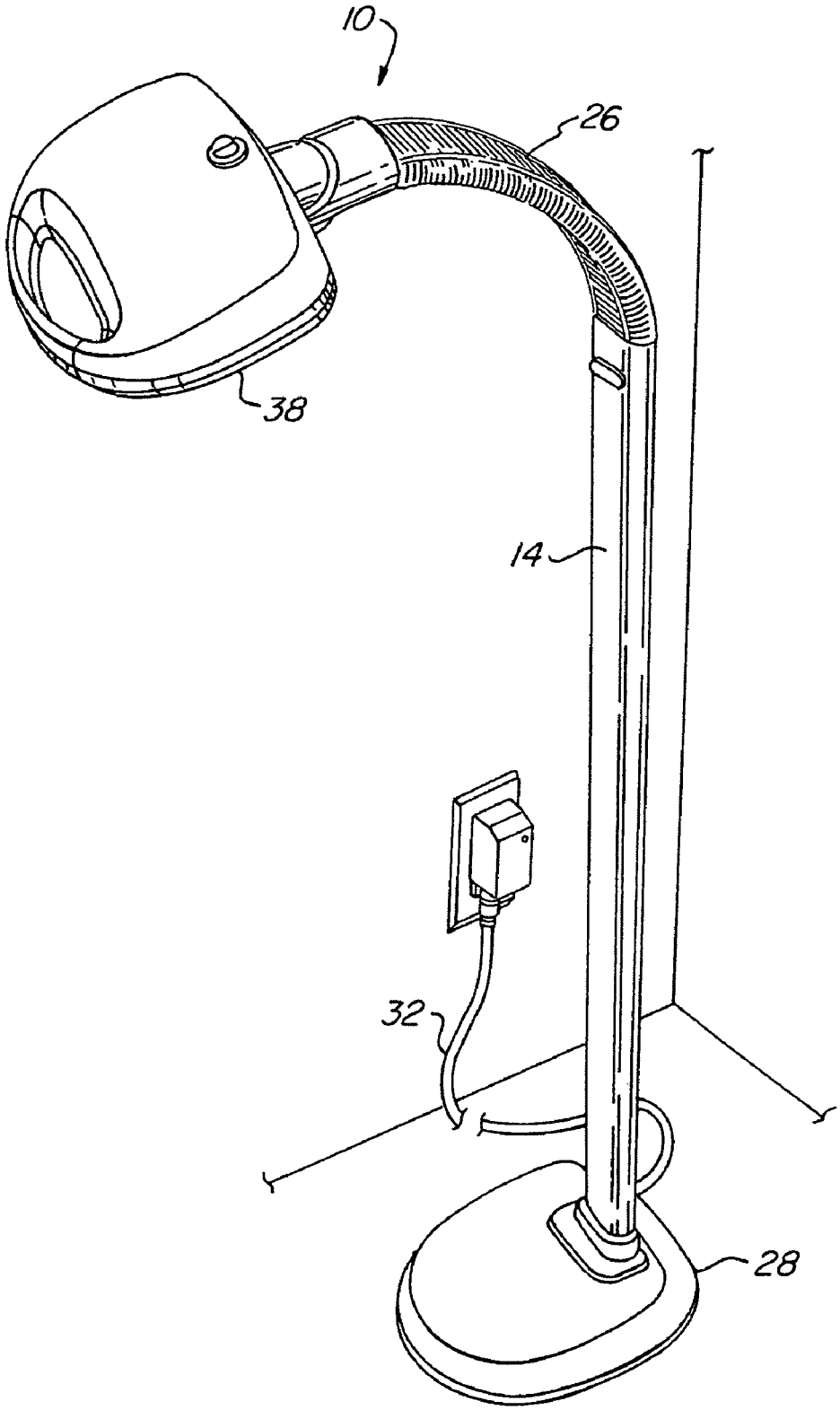
FIG. 1 depicts the lamp assembly in accordance with the invention.

FIG. 1 depicts the lamp assembly 10 in accordance with the invention. Lamp assembly 10 includes lamp head 38 for emitting light, base 28 and post 14 for supporting lamp head 38, and a flexible neck 26 for adjustably positioning lamp head 38 in a variety of positions. Electrical cord 32 brings electricity from a wall socket to lamp assembly 10.

Referring to FIGS. 3*a*-3*c*, post 14 includes a top end 16 and a bottom end 18, where bottom end 18 further includes a recess 20. As shown in FIGS. 4*a*-4*d*, base 28 includes a post receiver 30 and a protrusion 32 that, when bottom end 18 is placed in post receiver 30, engages with recess 20 for securing post 14 to base 28. To place post 14 within base 28, a user merely inserts post 14 downwardly into post receiver 30 and protrusion 32 engages with recess 20 without a need for fasteners or tools. To remove post 14, a user inserts a finger, or other long and slender instrument, such as a screwdriver, into post receiver 30 upwardly from a bottom hole 34 of base 28 and pushes protrusion 32 in a lateral direction to disengage recess 20 from protrusion 32 and separates post 14 from base 28.

In some embodiments, post 14 includes an extendable portion that lengthens post 14 in an axial direction. The extendable portion may be placeable inside post 14 and withdrawn from post 14 and fixed at a desired length.

Figure 2A:
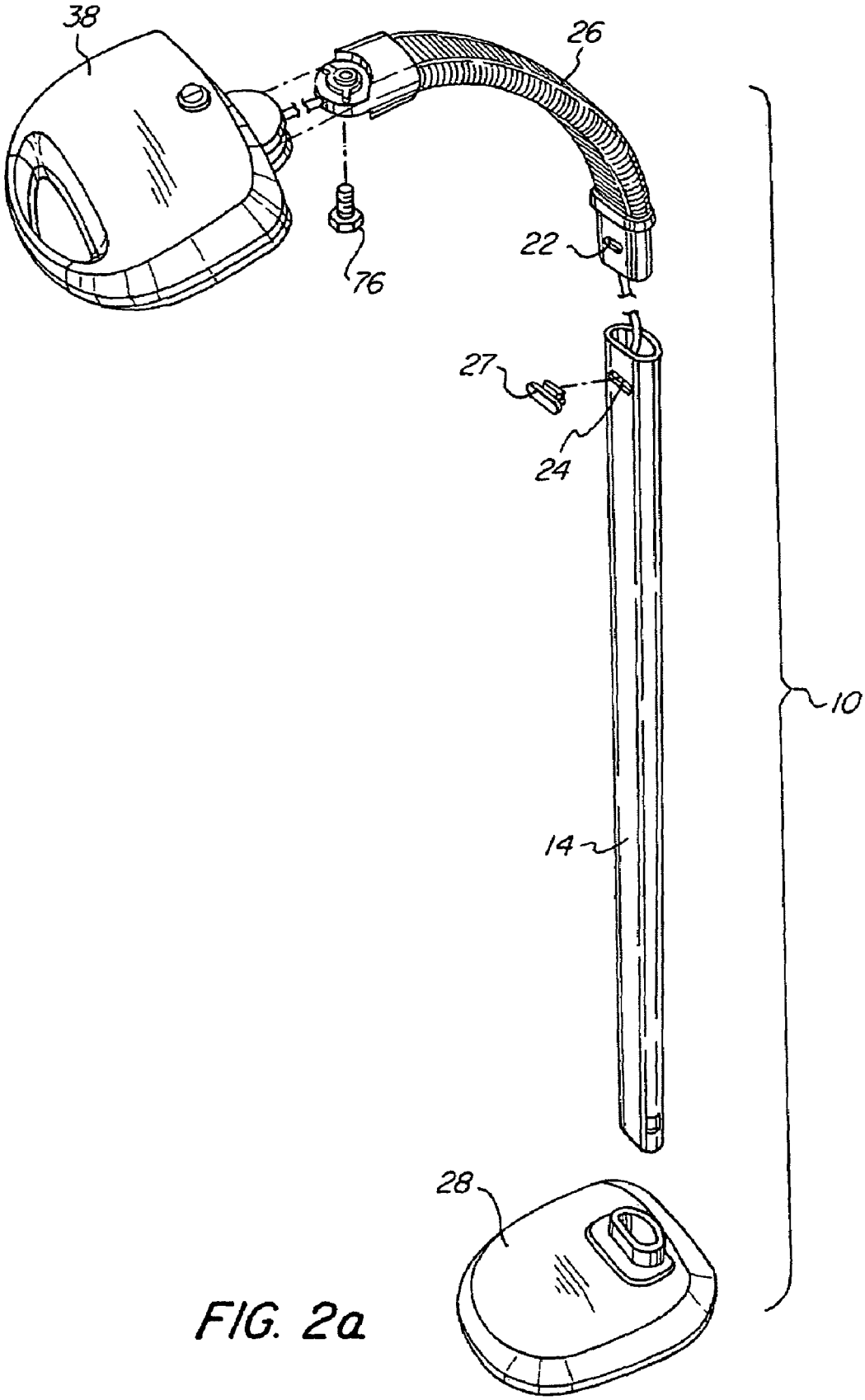
FIG. 2*a* depicts the components of the lamp assembly of FIG. 1 being assembled and disassembled.
Figure 2B:
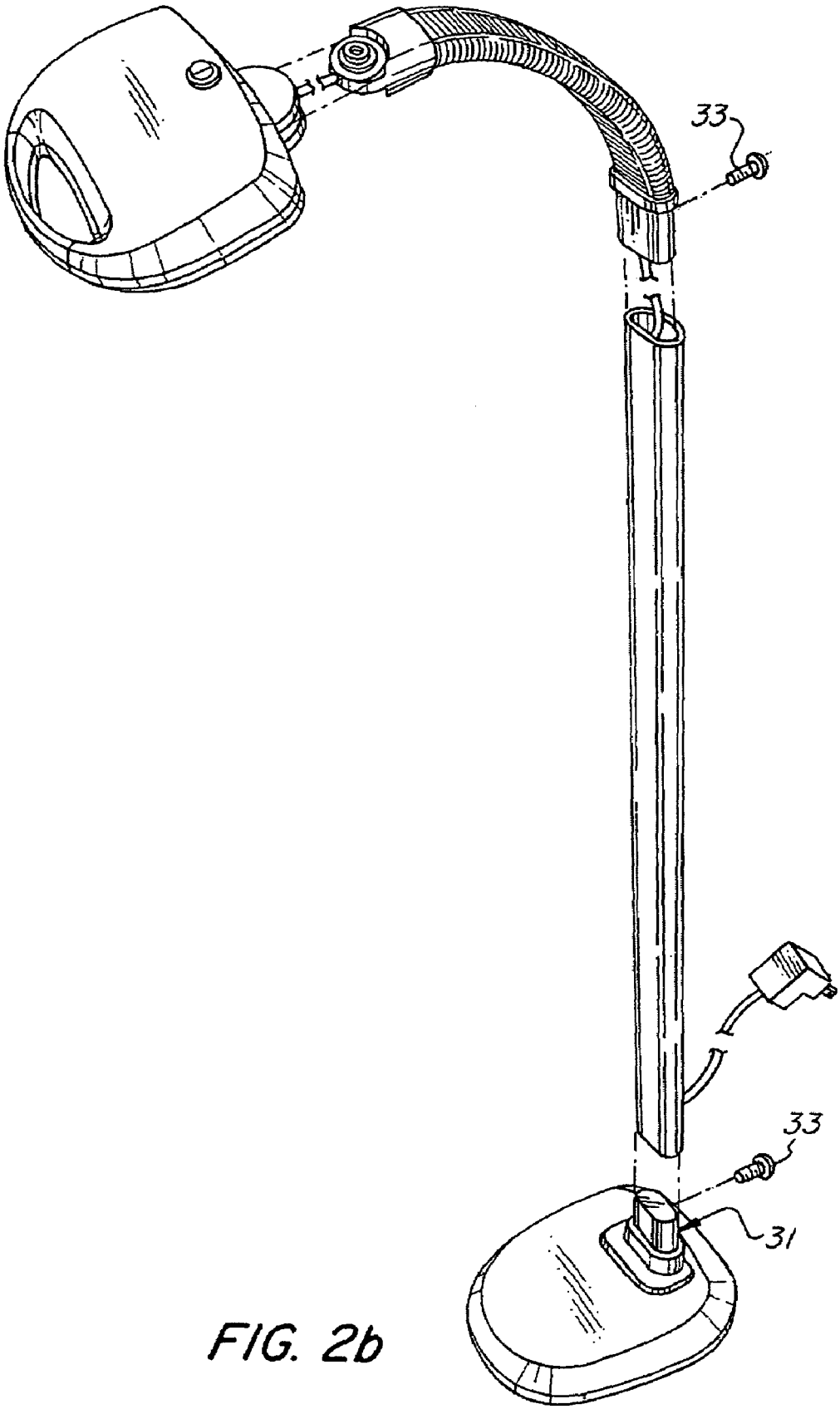
FIG. 2*b* depicts the components of the lamp assembly being assembled with fasteners.
Figure 4A:
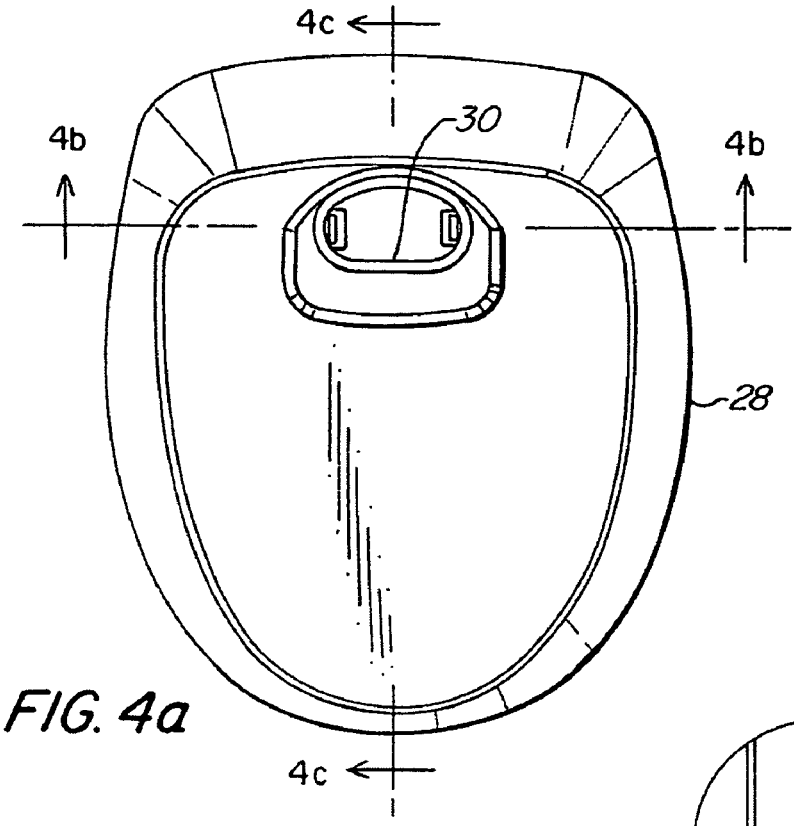
FIG. 4*a* depicts a top view of the base of the lamp assembly.
Figure 4D:
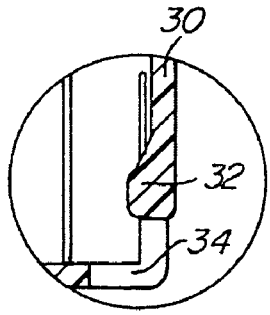
FIG. 4*d* depicts an exploded view of the base of the lamp assembly.
Figure 4B:
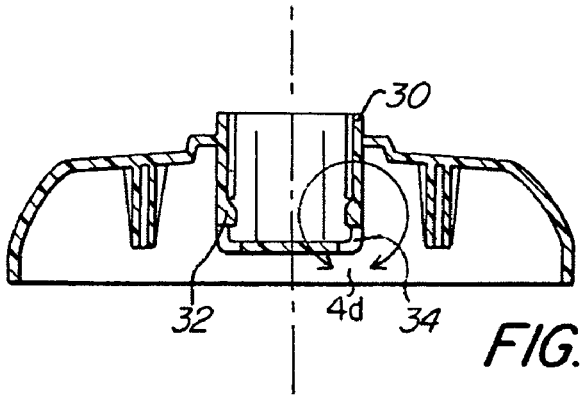
FIG. 4*b* depicts a sectional view of the base of the lamp assembly.
Figure 4C:
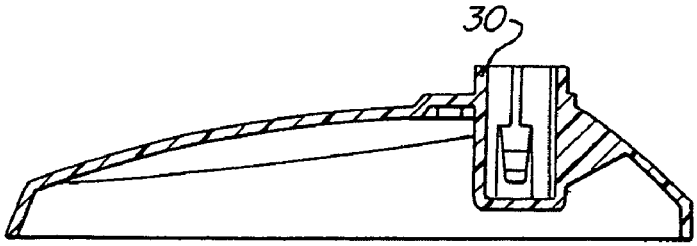
FIG. 4*c* depicts another sectional view of the base of the lamp assembly.

Referring to FIG. 2*b*, fasteners replace pin 27, recess 20, and protrusion 32. As shown, neck 26 is secured to post 14 by fastener 33, which may be a screw, rivot, nail, or staple. Furthermore, post 14 is secured to base 28 by fastener 33, which secures post 14 to stabilizer 31. Stabilizer 31 is a member that extends from base 28 and fits inside post 14 for stabilizing post 14 to base 28. Fastener 31 passes through post 14 and stabilizer 31. Preferably, stabilizer 31 fits snugly within post 14.

Figure 5C:
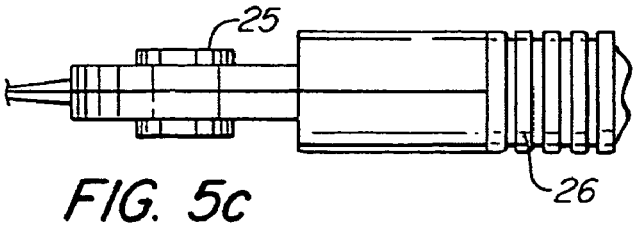
FIG. 5*c* depicts a top part of the flexible neck of the lamp assembly.
Figure 5A:
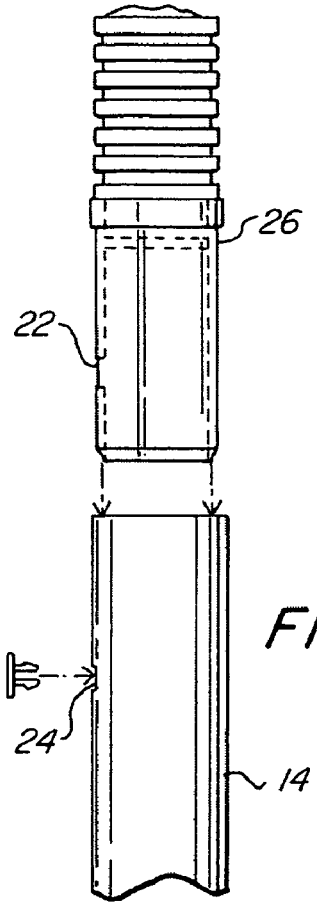
FIG. 5*a* depicts a front view of the flexible neck of the lamp assembly being coupled with the post.
Figure 5B:
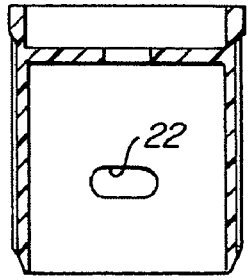
FIG. 5*b* depicts a side view of the flexible neck of the lamp assembly.
Figure 6B:
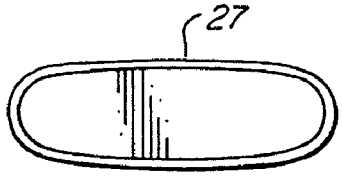
FIG. 6*b* depicts a top view of the cotter pin used to secure the flexible neck to the post.
Figure 6C:
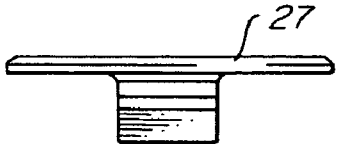
FIG. 6*c* depicts a front view of the cotter pin used to secure the flexible neck to the post.
Figure 6A:
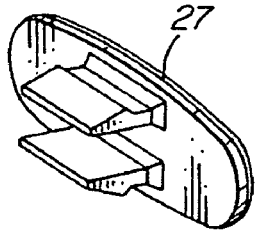
FIG. 6*a* depicts a perspective view of the cotter pin used to secure the flexible neck to the post.

Top end 16 also includes an aperture 24 which mates with an opening 22 in flexible neck 26 (see FIGS. 2 and 5*a*-5*b*). Referring to FIGS. 2, 5*a*, and 6*a*-6*c*, a cotter pin 27 is inserted through aperture 24 and opening 22 to secure neck 26 to post 14. Post 14 and neck 26 are easily attached and separated from one another by merely inserting and removing pin 27.

It is desired for post 14, neck 26, and base 28 to be compatible with a variety of lamp assemblies and, therefore, may serve as easily interchangeable replacement components with numerous lamp assemblies.

Figure 7:
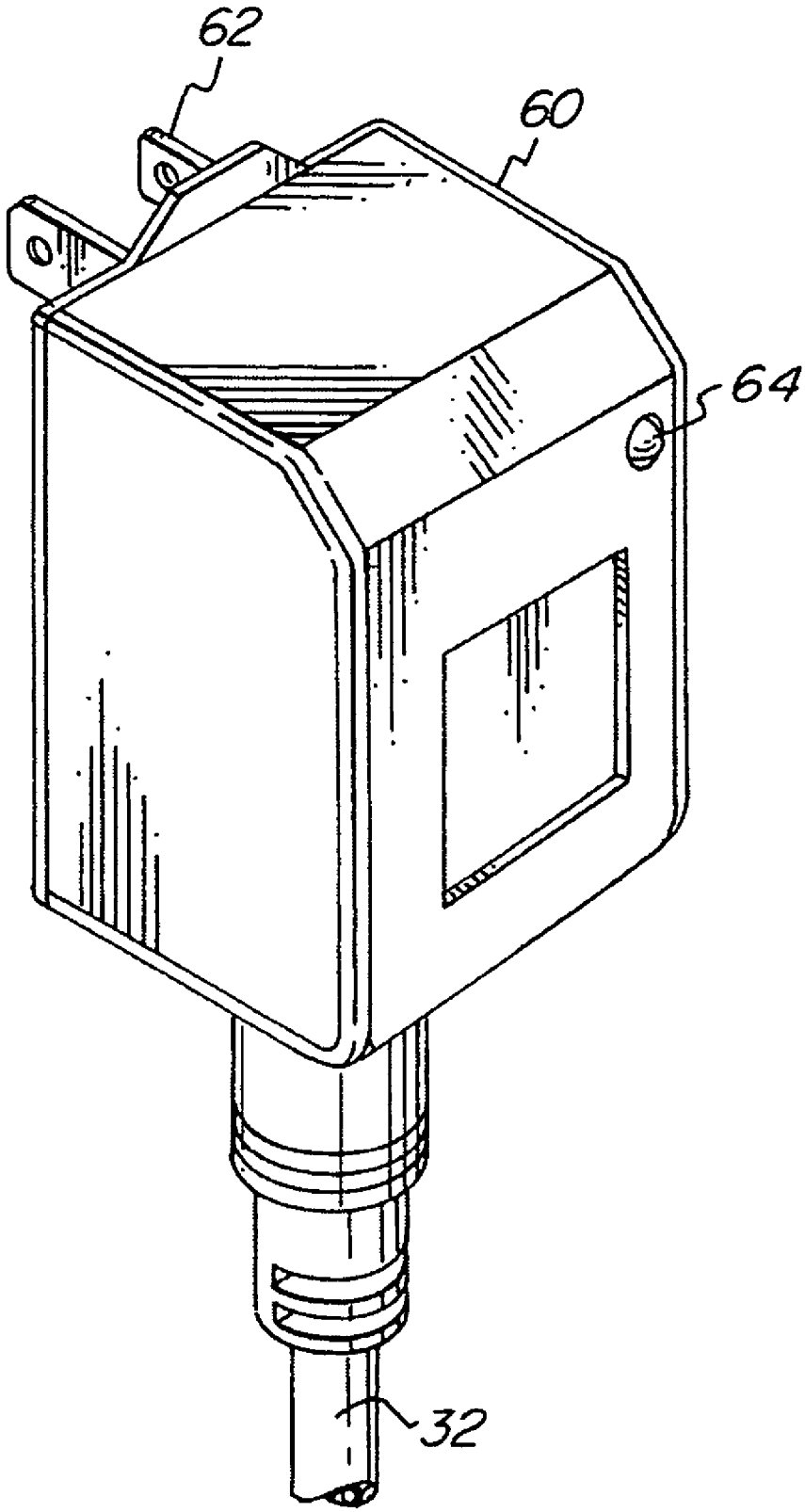
FIG. 7 depicts a ballast of the lamp assembly.

In some embodiments, lamp assembly 10 also includes ballast 60 for helping to maintain a consistent current flow through lamp assembly 10 by varying its resistance when counteracting changes in voltage. FIG. 7 shows ballast 60 also includes plug 62 that is insertable into a wall socket to draw electricity from the wall socket to lamp assembly 10. In other embodiments, ballast 60 is not necessary for lamp assembly 10 to provide light and, therefore, electrical cord 32 connects directly to plug 62.

As shown, electrical cord 32 may be attached to ballast 60, where ballast 60 further includes an indicator light 64 for indicating a problem with lamp assembly 10. The type of problem that may be indicated includes, but is not limited to, a location of the problem on assembly 10, a type of failure with assembly 10, or both. The location of the problem may be such areas as lamp head 38, electrical cord 32, post 14, base 28, or ballast 60. A type of failure may be a damaged light bulb, short circuit within assembly 10, frayed wires, or failed electrical connection such as when electrical cord 32 is not properly connected to base 28.

As shown, indicator light 64 illuminates to show that electricity is reaching lamp head 38 and, therefore, that there is a successful electrical connection from the wall socket to lamp head 38. When not illuminated, indicator light 64 shows that electricity is not reaching lamp head 38 and that there is a failed electrical connection, such as electricity not coming out of the wall socket or a failure at ballast 60.

In further embodiments, more than one indicator light 64 is placed on ballast 60 where, depending upon the light or lights that illuminate, a problem is more specifically located on lamp assembly 10, such as indicating the specific location of the failed connection on assembly 10. Moreover, depending upon the light or lights that illuminate, the type of failure may be indicated, such as a damaged bulb or damaged wires.

In other embodiments, ballast 60 includes a plurality of indicator lights 64 that illuminate with different colors to further indicate a location and/or type of problem with assembly 10. For example, blue may indicate a damaged light bulb or green may indicate a damaged electrical cord 32.

Figure 9:
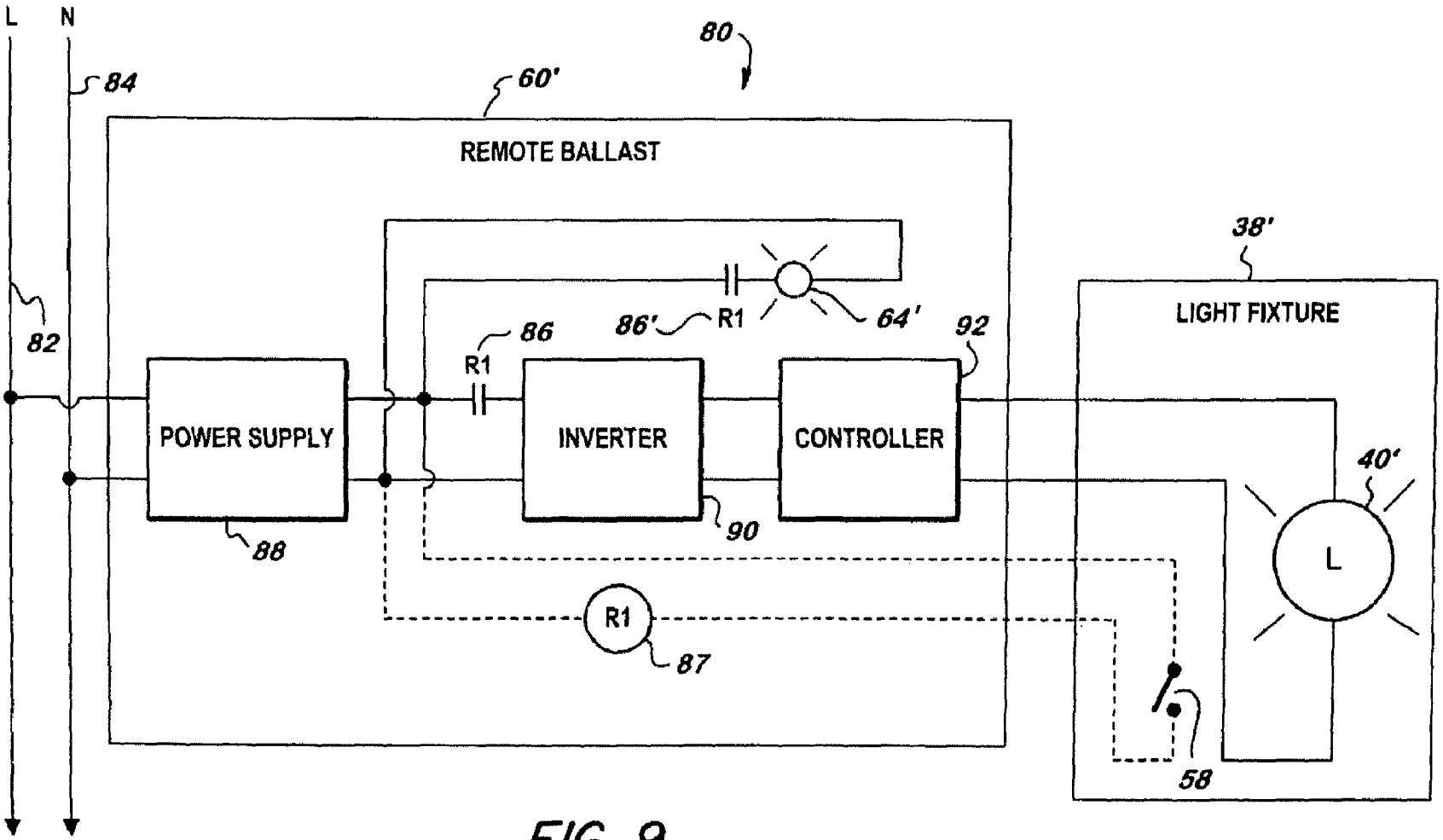
FIG. 9 depicts an electric circuit for providing power to the ballast of FIG. 7.

FIG. 9 depicts an electric circuit 80 for wiring ballast 60'. It is understood that the invention should not be limited to the circuit diagram depicted in FIG. 9 because there are many possible ways for providing power to ballast 60' using a variety of different wiring diagrams. Depicted is merely one example of a wiring diagram for ballast 60'.

Typical components that may be found within ballast 60' include a power supply 88 for transforming the supply voltage from, for instance, 120VAC to a higher or lower voltage. Another component may include an inverter 90 for changing the frequency of the electrical power received from the power source to a different frequency. Another component may include a controller 92 which may, for instance, provide for signal conditioning.

Circuit 80 includes schematic diagrams of ballast 60', lamp head 38', and bulb 40'. For instance, electrical power from a wall socket is delivered to ballast 60' via line 82, designated L, and neutral 84, designated N.

Line 82 is connected to power supply 88, which is then connected to inverter 90 after passing through relay contact 86, which acts as a switch. If relay contact 86 is opened, the circuit is opened and power is not delivered to anything beyond power supply 88, including light 40' or indicator light 64'. Relay coil 87 is actuated by switch 58, which is remotely located from ballast 60', relay contact 86 and 86', and relay coil 87. As shown, switch 58 is placed on lamp head 38'. However, switch 58 may be located anywhere that is more desirable, such as on post 14, flexible neck 26, or base 28. As shown, switch 58 may be turned to an off position by a user, which in turn opens contacts 86 and 86'. Switch 58 is further described below. When switch 58 is in an on position, relay coil 87 is energized and contacts 86 and 86' are closed, thereby powering indicator light 64' and light 40'. If switch 58 is on, indicator light 64' is also on because contact 86' is closed. If light 40' is not emitting light, that means light 40' needs replacing. If switch 58 is on and indicator light 64' is off, that means insufficient power is leaving power source 88 and that there is a failure at ballast 60'.

Similar to the other components of lamp assembly 10, both ballast 60' and electrical cord 32 are removably connected to each other and with base 28 by mere insertion of one end of electrical cord 32 into base 28 and the other end into ballast 60'.

Referring to FIGS. 8*a*-8*f*, lamp head 38 includes bulb 40 and socket 44 for providing light. Bulb 40 is attached to a base 42, which in turn is removably placed into socket 44. When replacing damaged bulbs 40, base 42 simply separates from socket 44 and a replacement bulb 40 and base 42 may be inserted into socket 44. Socket 44 has electrical leads that mate with the electrical leads of base 42 and which supply power to emit light from bulbs 40.

Figure 8A:
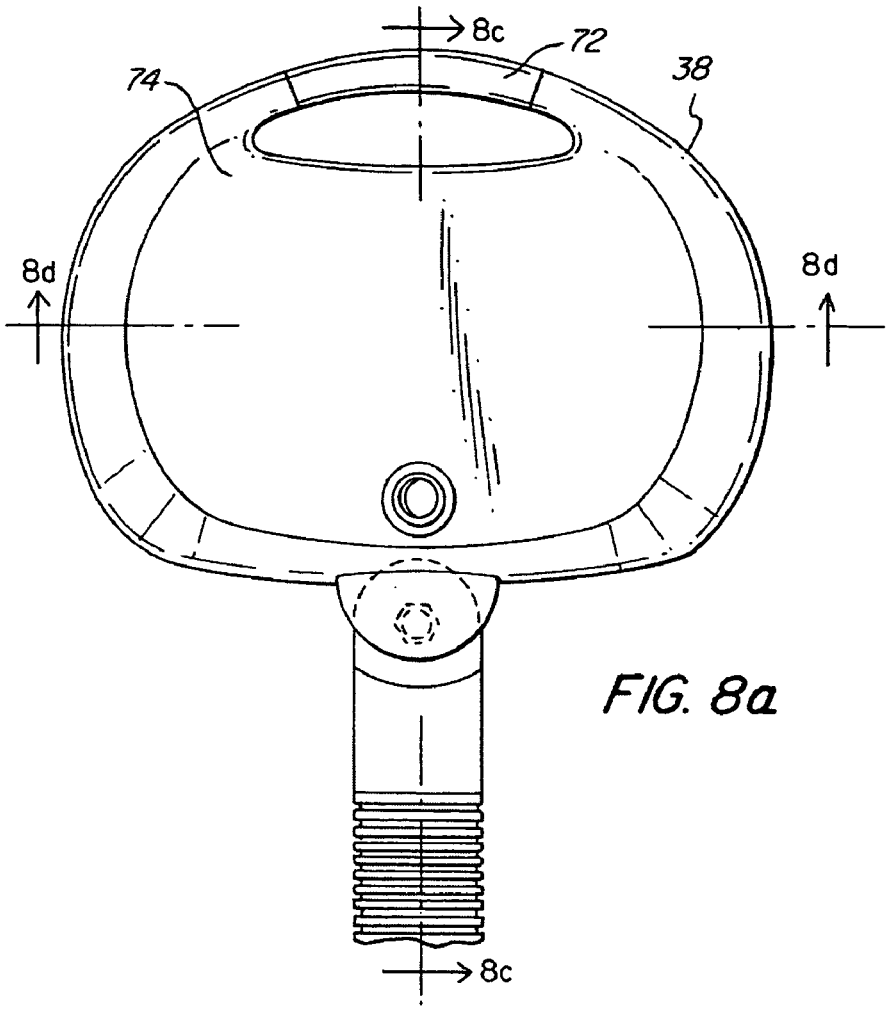
FIG. 8*a* depicts a top view of the lamp head of the lamp assembly.
Figure 8B:
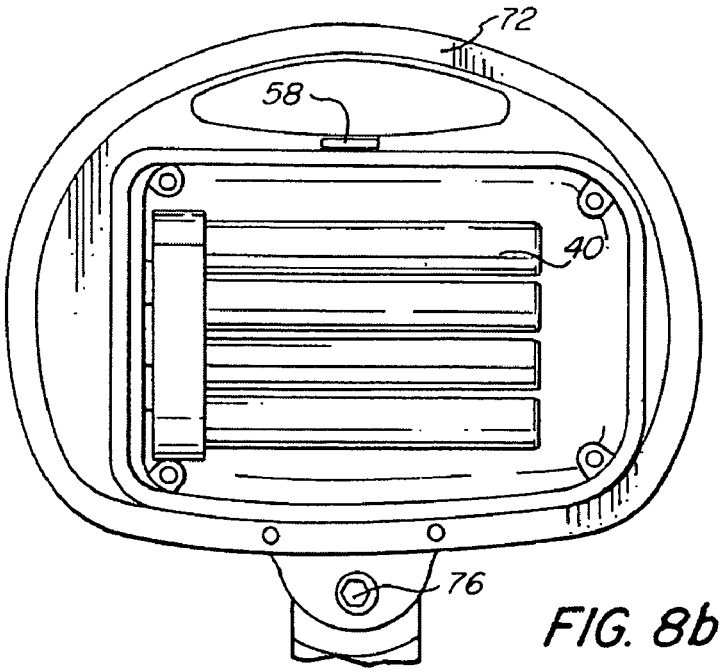
FIG. 8*b* depicts a bottom view of the lamp head of the lamp assembly.
Figure 8C:
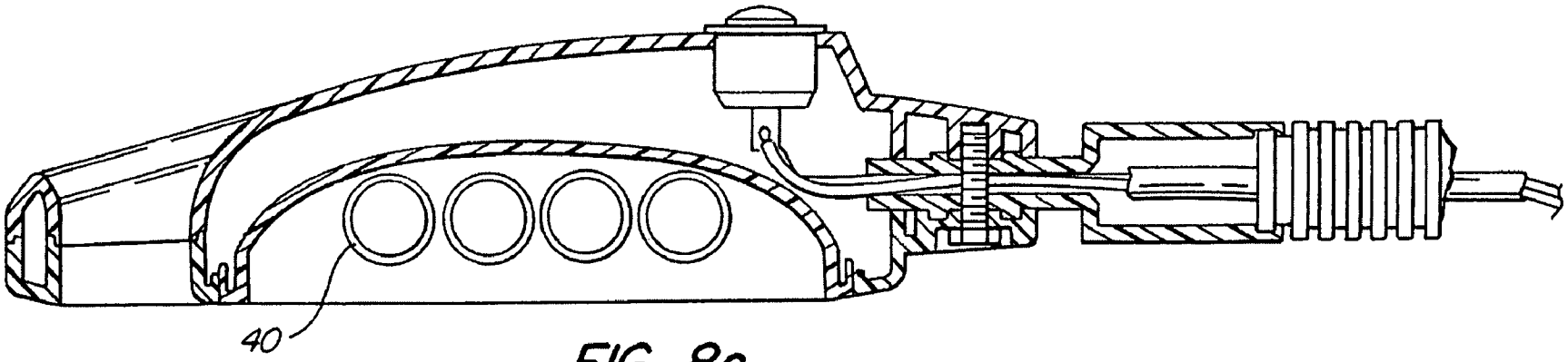
FIG. 8*c* depicts a sectional view of the lamp head of the lamp assembly.
Figure 8D:
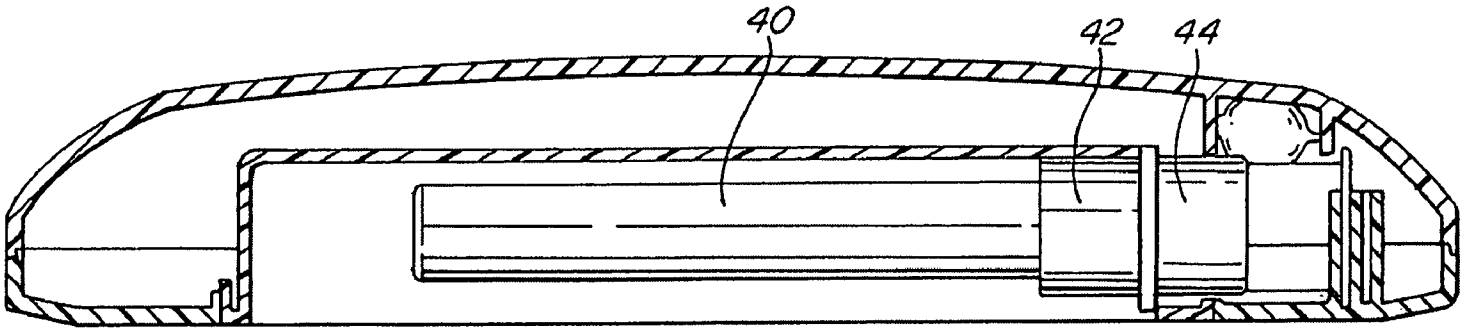
FIG. 8*d* depicts another sectional view of the lamp head of the lamp assembly.
Figure 8E:
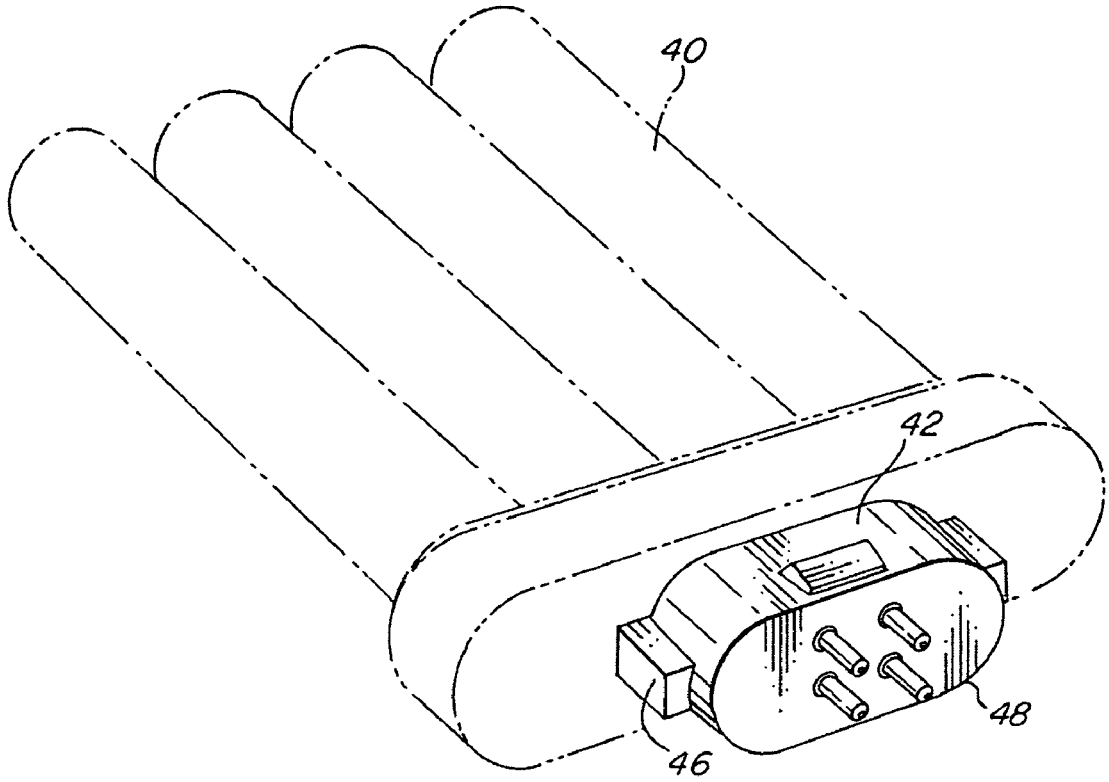
FIG. 8*e* depicts a perspective view of the light bulb used in the lamp head.
Figure 8F:
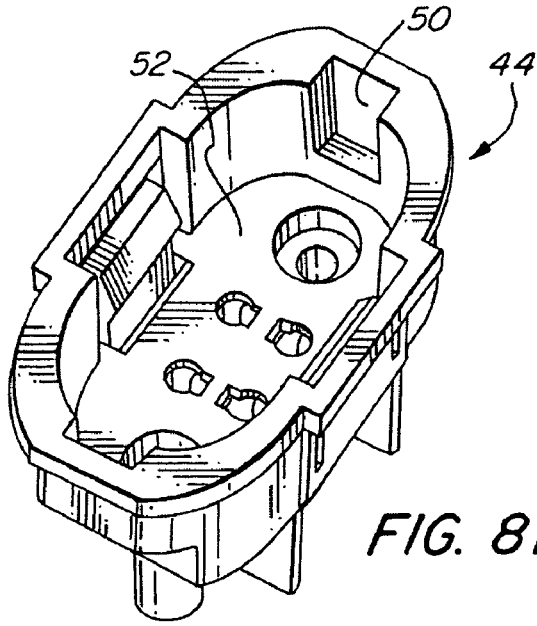
FIG. 8*f* depicts a perspective view of the socket used in the lamp head.

Referring to FIGS. 8*e* and 8*f*, base 42 includes at least one extension 46 outside a periphery 48 of base 42. At least one extension 46 acts as a guide for properly inserting and/or removing base 42 into and from socket 44. Socket 44 includes at least one notch 50 in a wall of a cavity 52 within socket 44 for receiving at least one extension 46, where cavity 52 receives periphery 48 of base 42. Notch 50 is any indentation, recess, channel, gouge, or the like in the wall of cavity 52.

At least one notch 50 is typically sized to be slightly larger than at least one extension 46. In other embodiments, at least one notch 50 may be much larger than at least one extension 46. All that is necessary is that at least one notch 50 is larger than at least one extension 46 so that extension 46 fits within notch 50. In further embodiments, the invention dispenses with both extensions 46 and notches 50. In these embodiments, periphery 48 of base 42 is simply placed within cavity 52 without any guiding mechanisms.

As shown in FIGS. 5*c* and 8*a*-8*b*, lamp head 38 is connected to flexible neck 26 by inserting bolt 76, or other fastening mechanism, through hole 25 in flexible neck 26 and in lamp head 38 (hole in lamp head not shown). As shown, lamp head 38 is able to pivot about bolt 76 and relative to flexible neck 26.

As shown in FIG. 8*b*, lamp assembly 10 also includes a switch 58 proximate to lamp head 38 and remote from ballast 60 for turning lamp assembly 10 on and off. Switch 58 should not be limited to the location depicted and may be located anywhere on lamp assembly 10 that is convenient to a user.

As shown, although switch 58 is proximate to lamp head 38, when switch 58 is in an off position, the flow of electricity is terminated at ballast 60. This acts as a fail safe mechanism and provides an advantage in safety over traditionally lamp assemblies where the flow of electricity terminates at the switch. Therefore, in traditional assemblies, there is electricity flowing through the electrical cord and this presents a fire hazard, especially if the user mistakenly assumes that, because the switch is off, the assembly is free from having electricity flowing within it.

Lamp head 38 also includes a handle 72 positioned on a front 74 of lamp head 38. This location for handle 72 facilitates maneuverability of lamp head 38 in that a user's wrist need not be bent to a significant degree in order to manipulate handle 72. In some embodiments, handle 72 provides ergonomic relief to a user, particularly to arthritis sufferers. Handle 72 may further be integrally formed with lamp head 38 and includes a protective non-slip coating.

Although the invention has been described with reference to a particular arrangement of parts, features and the like, these are not intended to exhaust all possible arrangements or features, and indeed many other modifications and variations will be ascertainable to those of skill in the art.

The invention claimed is:

1. A lamp assembly, comprising:

a ballast for substantially maintaining a constant current;

said ballast including a light positioned thereon for indicating a problem with the lamp assembly;

a switch positioned on a lamp assembly housing, said ballast coupled to said lamp assembly housing via an electrical cord such that said lamp assembly housing is located remotely from said ballast; and a circuit in cooperation with said switch that impedes electricity from passing through said ballast when said switch is in an off position.

2. The lamp assembly according to claim 1, wherein the problem includes a location on the lamp assembly.

3. The lamp assembly according to claim 1, wherein the problem includes a type of failure with the lamp assembly.

4. A light fixture assembly, comprising:

a light fixture having a lamp for providing illuminating light;

a ballast, remotely located from and coupled to said light fixture via an electrical cord;

an indicator, electrically coupled to and positioned on said ballast, said indicator providing a indication of a malfunction in the lamp assembly;

a switch, located on said light fixture for interrupting electrical power supplied to said ballast.

5. The lamp assembly according to claim 4 wherein said ballast comprises a power supply to be connected to electrical power, said power supply modifying the voltage of the electrical power.

6. The lamp assembly according to claim 5 wherein said ballast further comprises an inverter electrically connected to said power supply, said inverter modifying the frequency of the electrical power.

7. The lamp assembly according to claim 6 wherein said ballast further comprises a controller for controlling the electrical power applied to the lamp.

8. The lamp assembly according to claim 5 wherein said switch includes a relay contact in series with said power supply, the relay contact con-trolled by a relay coil electrically connected in series with said switch, such that upon actuation of said switch, electrical power to the lamp may be interrupted.

9. The lamp assembly according to claim 4 wherein said ballast is positioned in a casing having electrical prongs attached thereto for engagement with an electrical outlet, such that said ballast is located inline with an electrical power cord of the light fixture assembly.

10. The lamp assembly according to claim 9 wherein said indicator is positioned on the casing.

11. The lamp assembly according to claim 10 wherein said indicator comprises a light.

12. The lamp assembly according to claim 11 wherein said light comprises an LED.

* * * * *